US005878968A

United States Patent [19]

Anderson et al.

[11] Patent Number: 5,878,968

[45] Date of Patent: Mar. 9, 1999

[54] TUB GRINDER APPARATUS

[76] Inventors: Robert R. Anderson, 29774 Hwy. 257, Windsor, Colo. 80550; Charles T. Anderson, 14900 WCR 36, Platteville, Colo. 80651

[21] Appl. No.: 73,295

[22] Filed: May 6, 1998

[51] Int. Cl.[6] ..... B02C 13/28

[52] U.S. Cl. ..... 241/186.4; 241/101.761

[58] Field of Search ..... 241/194, 195, 241/101.761, 186.4, 186.5

[56] References Cited

U.S. PATENT DOCUMENTS

| | | | |
|---|---|---|---|
| 4,846,411 | 7/1989 | Herron et al. | 241/186.4 |
| 5,207,391 | 5/1993 | Anderson | 241/186.4 |
| 5,720,440 | 2/1998 | Bonner et al. | 241/186.4 |

OTHER PUBLICATIONS

Plana, Tub Grinder Wear Parts Jul. 1996.

*Primary Examiner*—Mark Rosenbaum
*Attorney, Agent, or Firm*—Dean P. Edmundson

[57] ABSTRACT

Tub grinding apparatus is described for grinding bulk materials (e.g. forage products such as hay) in a manner such that far fewer "fines" are produced. As a result, the ground forage materials are of higher quality and are more palatable for animals than forage materials which are processed with previous apparatus. Also, because there are fewer "fines" produced, there are fewer pollution problems and less wasted feed. The apparatus is able to grind forage material at a significantly lower speed than previously possible. The hammers are spaced closer together near the outer end of the rotor member.

11 Claims, 9 Drawing Sheets

TUB GRINDER APPARATUS

FIELD OF THE INVENTION

This invention relates to material processors or grinders of the type which are used to grind bulk materials or reduce the particle size of bulk materials (e.g., hay, straw, wood, etc.). More particularly, this invention relates to tub grinders which are used to grind bulk materials and reduce the particle size of the material.

BACKGROUND OF THE INVENTION

Tub grinders have been widely used for reducing the particle size of bulk materials. This type of apparatus includes a large tub having an open top for receiving bulk material to be processed. A stationary floor in the tub is in a generally-horizontal plane. A rotor member is mounted under the floor, and hammers or blades on the rotor extend into the tub through an opening in the stationary floor. The rotor is rotated at a high rate of speed, and the tub is rotated slowly. The rotor must be precision-built and balanced so as to eliminate vibration problems.

The hammers or blades on the rotor strike the bulk material and grind it into smaller particles. A screen having small apertures in it is positioned in close proximity to the rotor under the floor. The bulk material cannot pass through the screen until the particles are smaller than the apertures.

As the tub is rotated, the bulk material is continually urged against the rapidly-revolving rotor member where the high speed hammers strike the bulk material. The hammers are usually made from a piece of flat steel about 4 to 6 inches long with a hole punched through each end. The hammers are normally heat-treated, and the wear tip is surfaced with a hardened material to reduce the effect of the high-speed wear to which they are subjected, since the corners of the hammers wear off rapidly during high-speed impact with the bulk material. The hammers must be turned end-for-end or replaced often, since they lose their ability to push the material through the screens after the corners are worn down.

The processed bulk material either falls through the screen system and is carried out by conveying or it is carried around the rotor by the hammers and thrown out the back side of the rotor and back into the tub where it is pushed around again by the rotating tub. Then the process is repeated.

The rotor in a conventional tub grinder typically is rotated at a speed of about 1800 to 2500 rpm. Because tub grinders usually are powered by a farm tractor whose power take-off shaft turns at either 540 or 1000 rpm, a gear box or belt drive mechanism is needed to increase the rotor speed to the required rpm. This high rate of speed is necessary to produce sufficient centrifugal force to keep the short lightweight hammer extended and to keep the machine operating properly. When this type of machine is operated at a lower rate of speed, there is insufficient centrifugal force to keep the hammers extended when they contact the bulk material, whereby hammer fly-back occurs which reduces machine performance and can cause damage to the machine itself.

The conventional tub grinder utilizes a hammer tip speed of 780 to 900 feet per second at 1000 rpm PTO speed. Such grinders were originally designed to pulverize grains, bones and other hard brittle substances. When these machines are used to grind forage materials such as hay, they consume a large amount of power and create a significant amount of fine, powdered material. This dust makes the machine very unpleasant to operate. Also, the dust in the atmosphere creates pollution problems and wastes feed.

The leaves of the forage material contain the most nutrients. They are also the most fragile and they are easily pulverized into dust during the grinding process. When this dust is lost the overall quality of the forage is drastically reduced. When the ground forage is handled or exposed to windy conditions this loss continues until the ground forage product is consumed. Large ruminant animals (such as milk cows) need more roughage in their feed. If the feed has too many "fines", i.e., small particles of feed, health problems result for the cows which reduces milk production and animal value.

An improved tub grinder is described in my U.S. Pat. No. 5,207,391, incorporated herein by reference, which eliminates the need for a screen in tub grinding apparatus.

There has not heretofore been described tub grinding apparatus having the features and advantages provided by the present invention.

SUMMARY OF THE INVENTION

In accordance with the present invention there is provided improved tub grinding apparatus for grinding bulk materials in a manner such that fewer fines and less dust are created. The rotor member can be effectively rotated at a much slower speed than conventional tub grinders. Forage materials are effectively ground without pulverizing the leaves. As a result, very high quality feed can be produced which is preferred for feed for ruminant animals such as milk cows.

In one embodiment of tub grinding apparatus of the invention, the spacing between hammer elements along the length of the rotor member is such that the spacing between adjacent hammers is progressively decreased as the distance from the center of the tub is increased. This arrangement places more hammers near the outer end of the rotor.

The hammers can be provided which are heavier than those used in conventional tub grinders. It is also possible to use a rotor configuration where the hammers are fixedly secured (i.e. not pivotally mounted on the rotor). The rotor can be rotated at a slower rpm speed than normally used so as to effectively grind forage materials without producing significant fines or dust. The resulting feed is of very high quality and when fed to ruminant animals, fewer health problems result as compared to feeding products produced by conventional tub grinders.

Other features and advantages of the tub grinding apparatus of this invention will be apparent from the following detailed description and the accompanying drawings.

BRIEF DESCRIPTION OF THE DRAWINGS

The invention is described in more detail hereinafter with reference to the accompanying illustrative drawings wherein like reference characters refer to the same parts throughout the several views and in which.

DETAILED DESCRIPTION OF THE INVENTION

Figure 1:
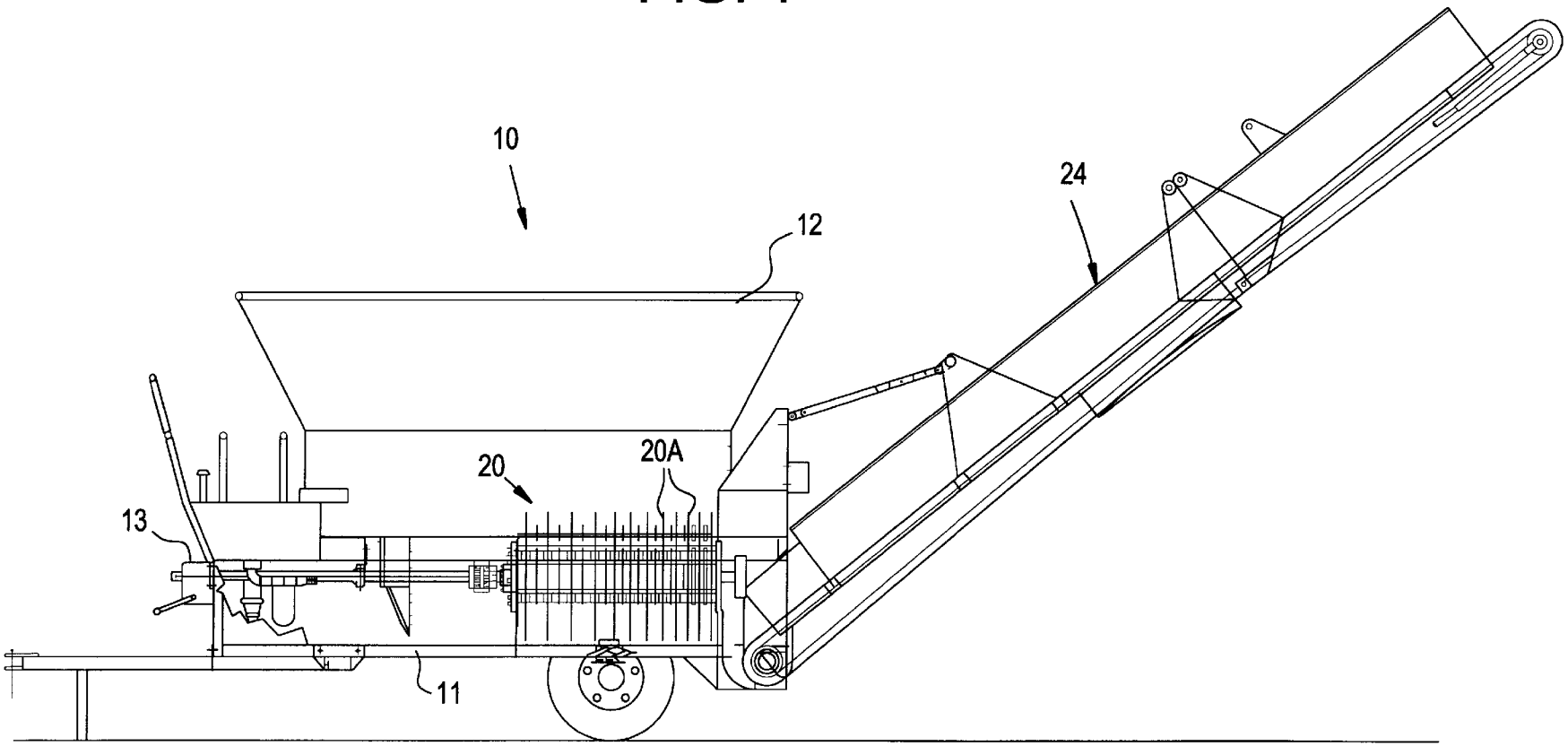
FIG. 1 is a side elevational, partially cut-away, view of a tub grinder apparatus of the invention.
Figure 2:
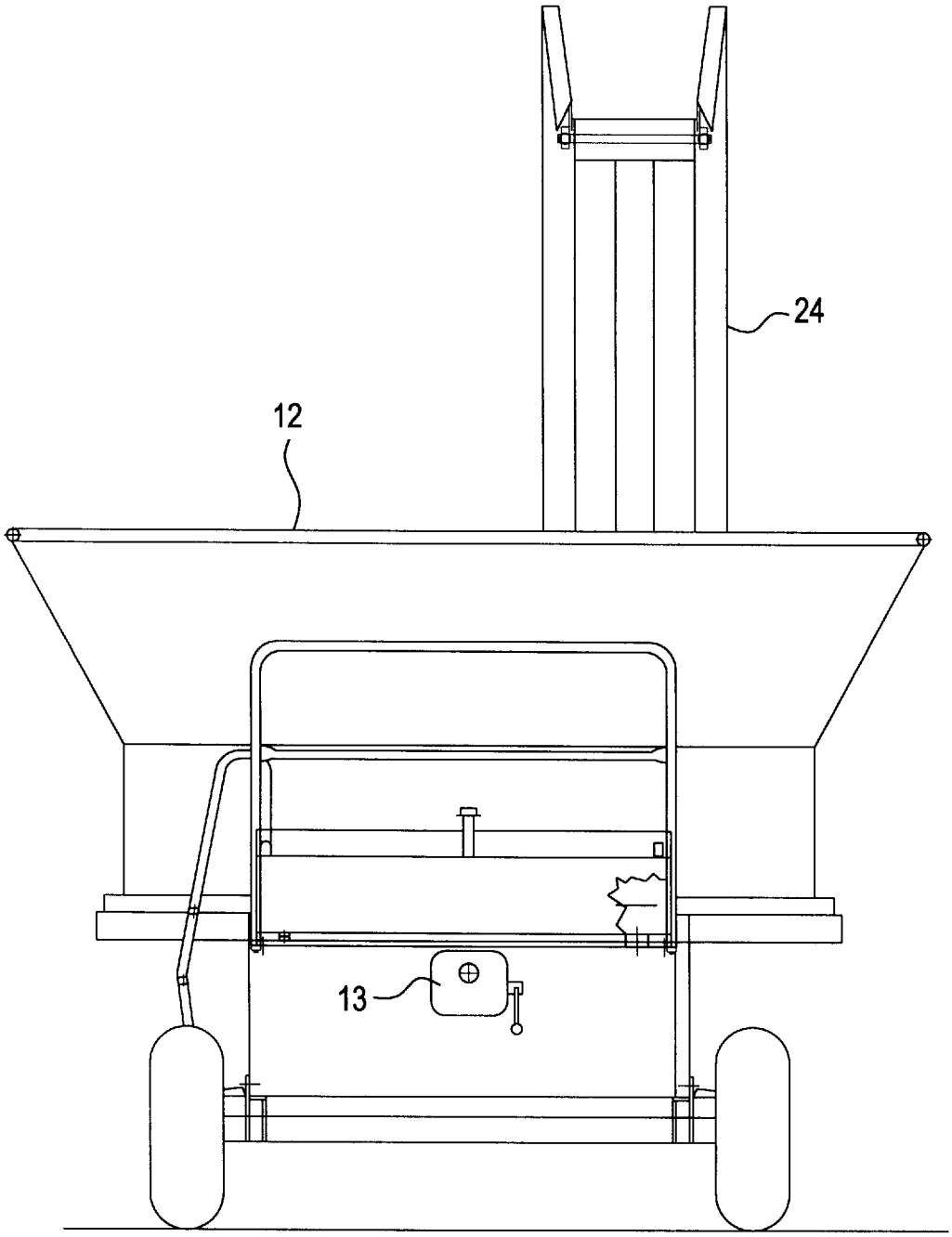
FIG. 2 is a front elevational view of the apparatus of FIG. 1.
Figure 3:
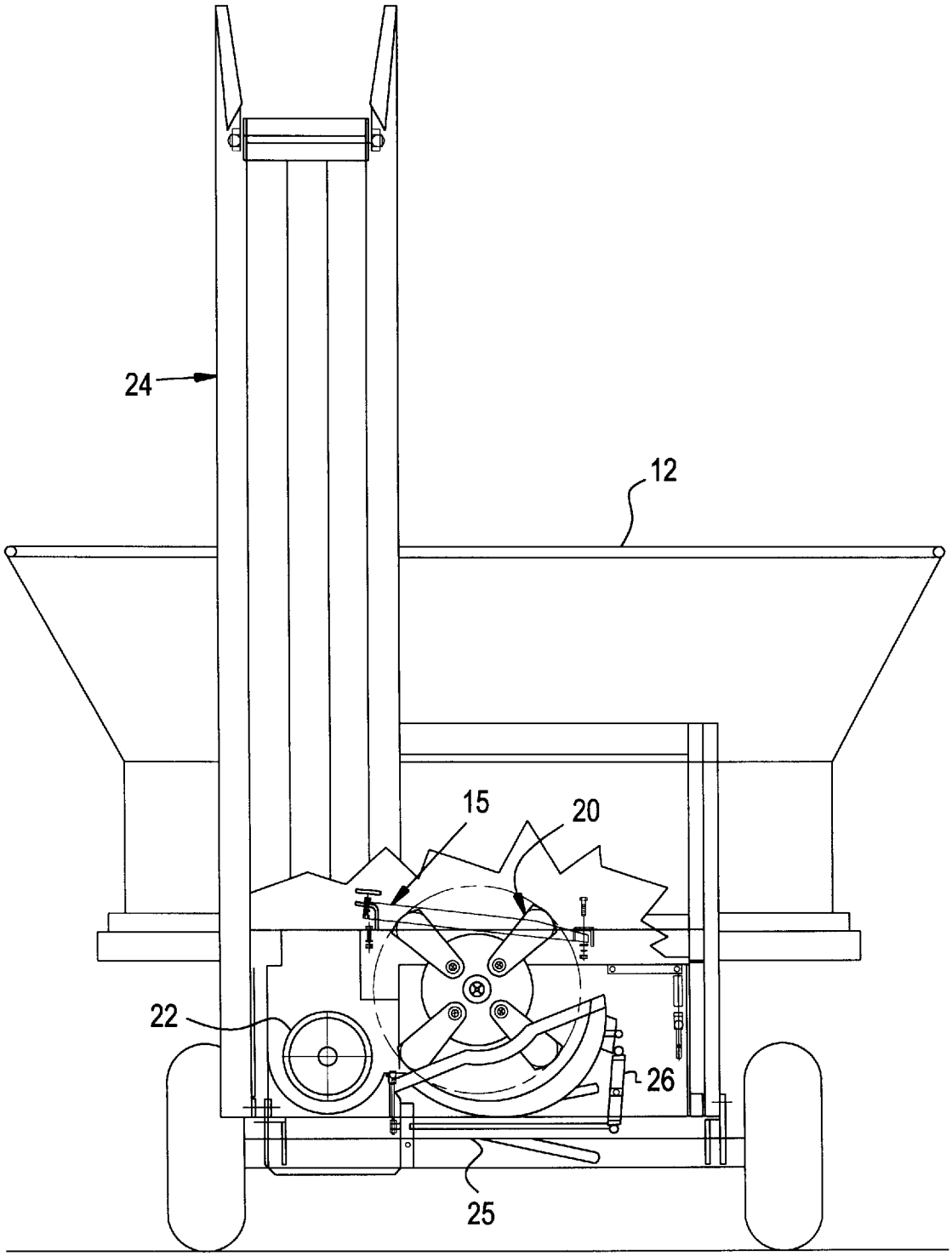
FIG. 3 is a rear elevational view, partially cut-away, of the apparatus of FIG. 1.

In the drawings there is shown a tub apparatus 10 comprising a rotatable tub 12 having a stationary floor 14 with an opening 14A in the floor. A rotor member 20 is rotatably mounted below the floor in the area of the opening 14A. A plurality of hammers 20A are carried by the rotor and extend radially outward. Elongated auger 22 is positioned adjacent to and extends substantially along the length of the rotor member below the floor 14 for the purpose of conveying the ground material to an elevator means 24. Preferably there is also a concave restricter means 25 positioned adjacent to and extending beneath and substantially along the length of the rotor member. The concave restricter means helps to hold the bulk material close to the rotor hammers during processing. Preferably there is included adjustment means 26 for adjusting the position of the concave restricter relative to the rotor member.

As shown in the drawings, there are more hammers on the rotor near the outer edge of the tub than there are near the center of the tub. In other words, the spacing between adjacent hammers along the rotor member decreases as the distance from the center of the tub increases. This feature is very advantageous because it provides more hammers on the rotor near the outer end of the rotor member where more bulk material in the tub must be shredded than near the center of the tub. Because of the rotation of the tub, the bulk material near the outer edge is forced against the hammers on the rotor at a greater rate than near the center of the tub. In one embodiment, the spacing between adjacent hammers becomes progressively smaller from the center of the tub to the outer edge of the tub. In another embodiment, the spacing between the first four hammers may be the same, the spacing between the next four hammers may be slightly less than the spacing between the first four hammers, and so on, until the outer end of the rotor is reached.

Another feature of the invention is the provision of feed control means in the tub for controlling the depth of penetration of the hammers into the bulk material. In a preferred embodiment the feed control means comprises a series of spaced-apart parallel bars 15 each of which extends across the width of the opening 14A, as illustrated. The bars 15 are positioned between adjacent hammers so that the hammers extend upwardly between the bars. The height of the bars 15 above the floor determines the extent of penetration of the hammers into the bulk material being processed.

Figure 8:
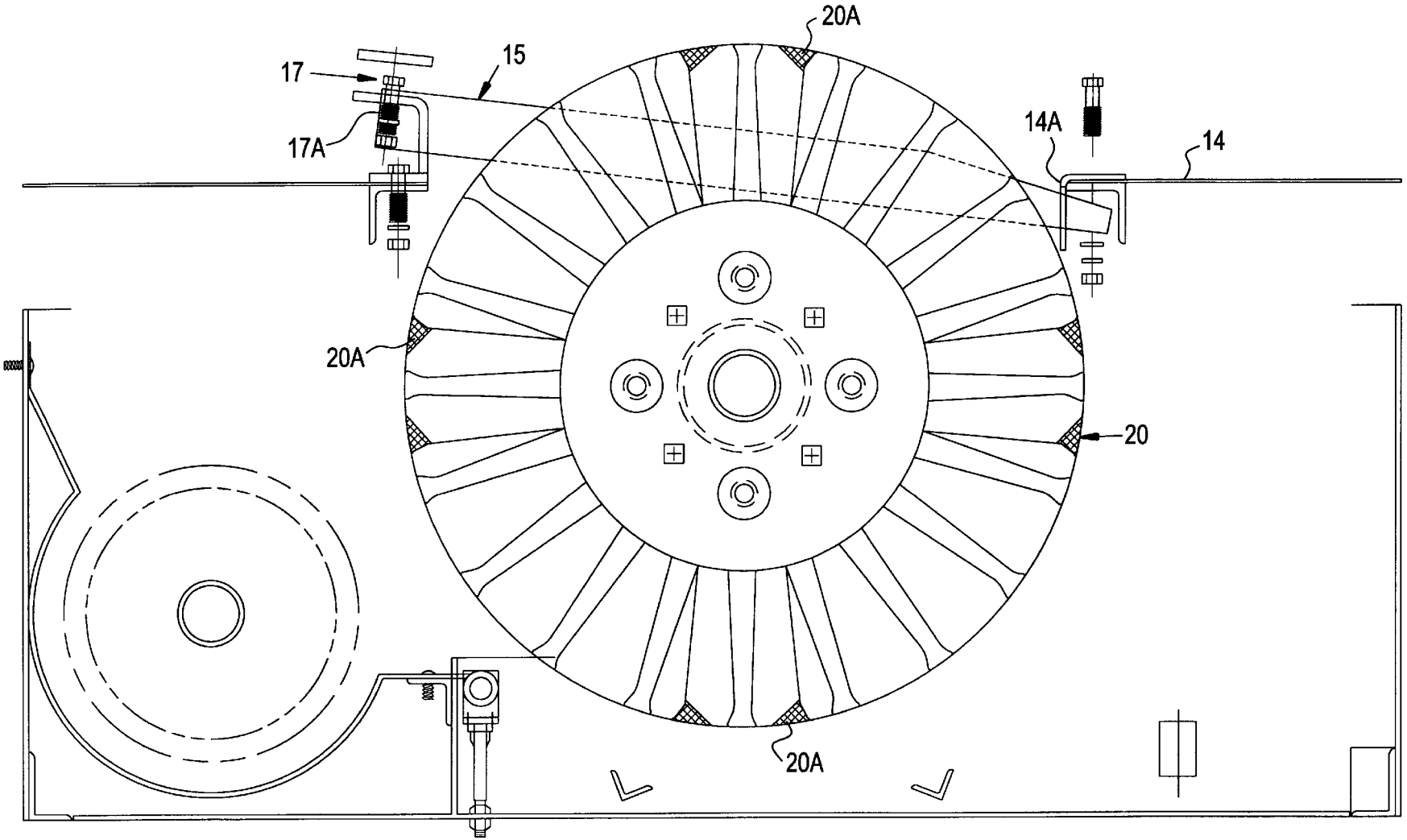
FIG. 8 is an end elevational view of a preferred embodiment of tub grinding apparatus of the invention.

One set of bars 15 may be removed and another set of a different height may be inserted, for example, in order to change the depth of penetration of the hammers. As another alternative, the bars 15 may be attached to a framework 17 which may be raised or lowered mechanically or hydraulically in order to raise or lower the bars. One manner of doing this is illustrated in FIG. 8 where threaded bolt 17A may be rotated in one direction to raise the framework and may be rotated in the opposite direction to lower it.

Figure 7:
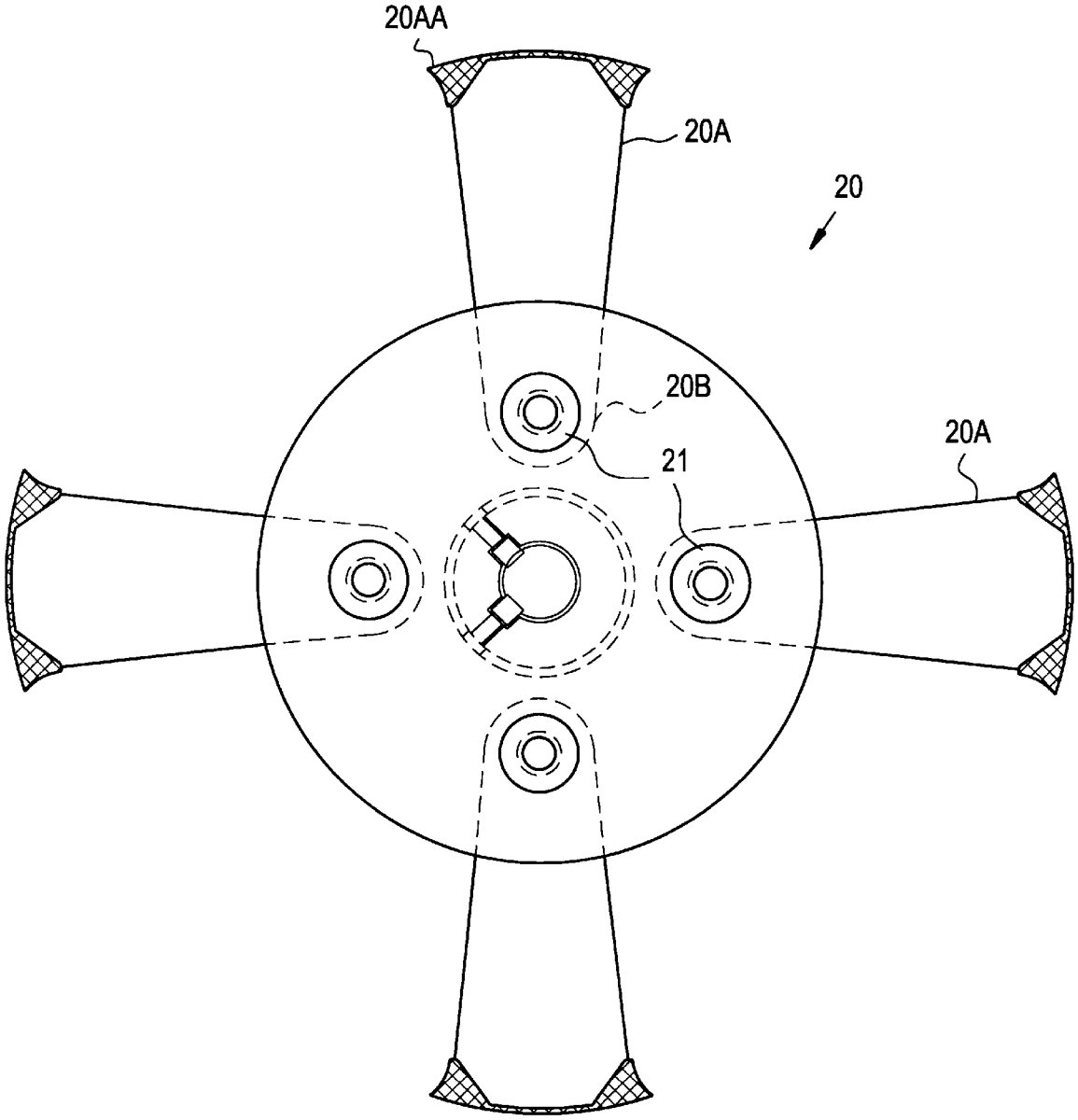
FIG. 7 is an end elevational view of a preferred embodiment of rotor apparatus useful in this invention.

Yet another feature of the apparatus of this invention is the use of hammers which are wider near their outer ends than at their inner ends. This is illustrated, for example, in FIG. 7 where the outer ends 20AA are wider than are the inner ends 20B which are pivotally attached to the rotor by means of bolts or pins. The wider outer ends provide considerably more kinetic energy than conventional hammers which are of uniform width.

Still another feature of the invention is that the speed of rotation of the rotor member is significantly lower than has been typically used in prior tub grinding apparatus. In the present invention the rotor member is rotated at the same speed as the tractor PTO speed (i.e., about 750 to 1200 rpm). Thus, there is no need for a gear box to increase the rpm of the rotor member above the tractor PTO speed when processing most forage materials such as hay. The ability to use a direct drive (with no gear box required) reduces manufacturing cost of the apparatus and also the maintenance costs. The tip speed of the hammers in the apparatus of this invention is about 480 feet per second at a 1000 rpm PTO speed.

If desired, a gear box 13 may be included to either increase or decrease the rotor speed. For processing certain materials (e.g. corn stalks or cane), it may be desirable to increase the rotor speed to improve the shredding of tough materials.

Figure 4:
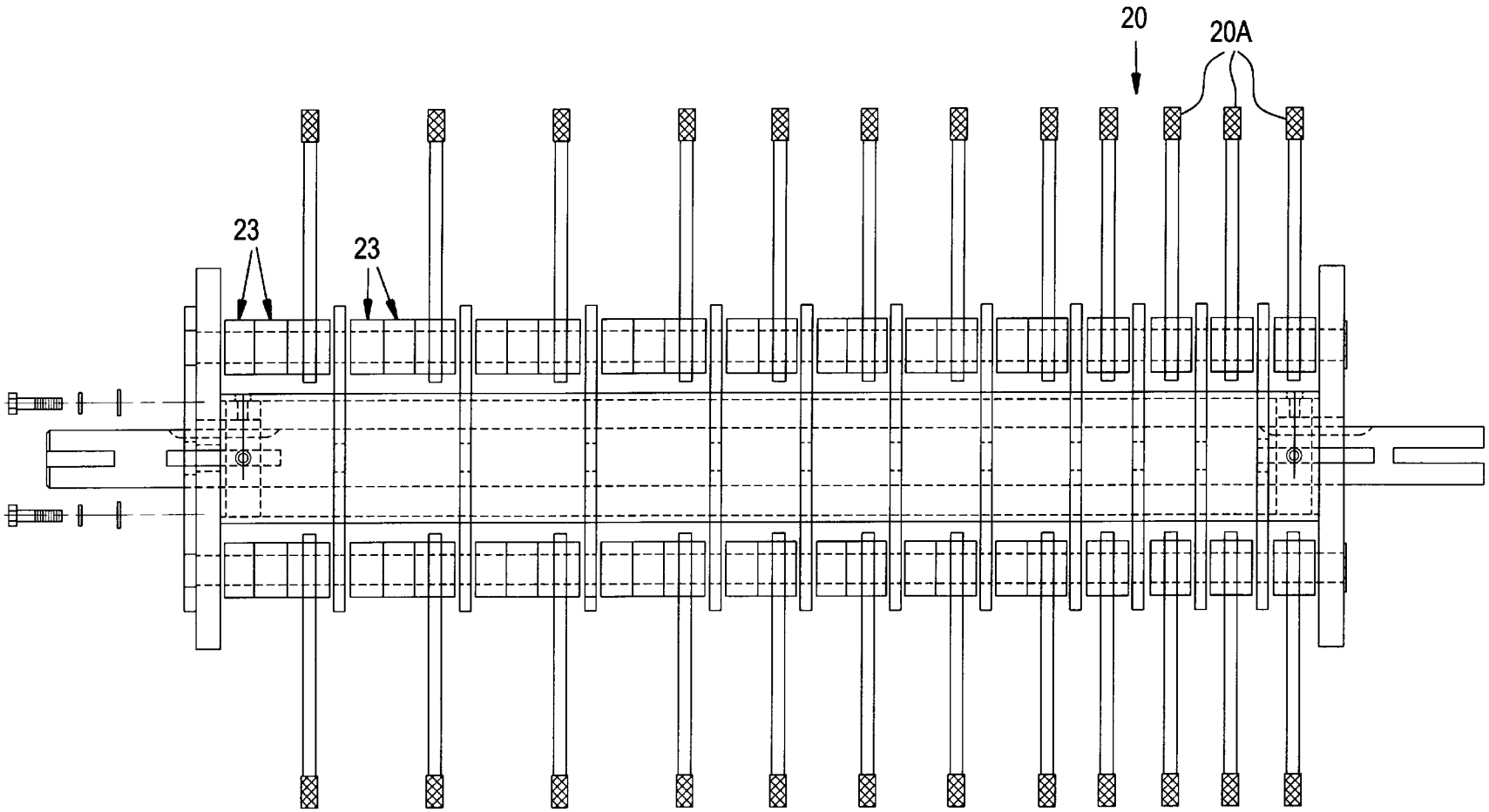
FIG. 4 is a top view of one embodiment of rotor apparatus useful in this invention.
Figure 5:
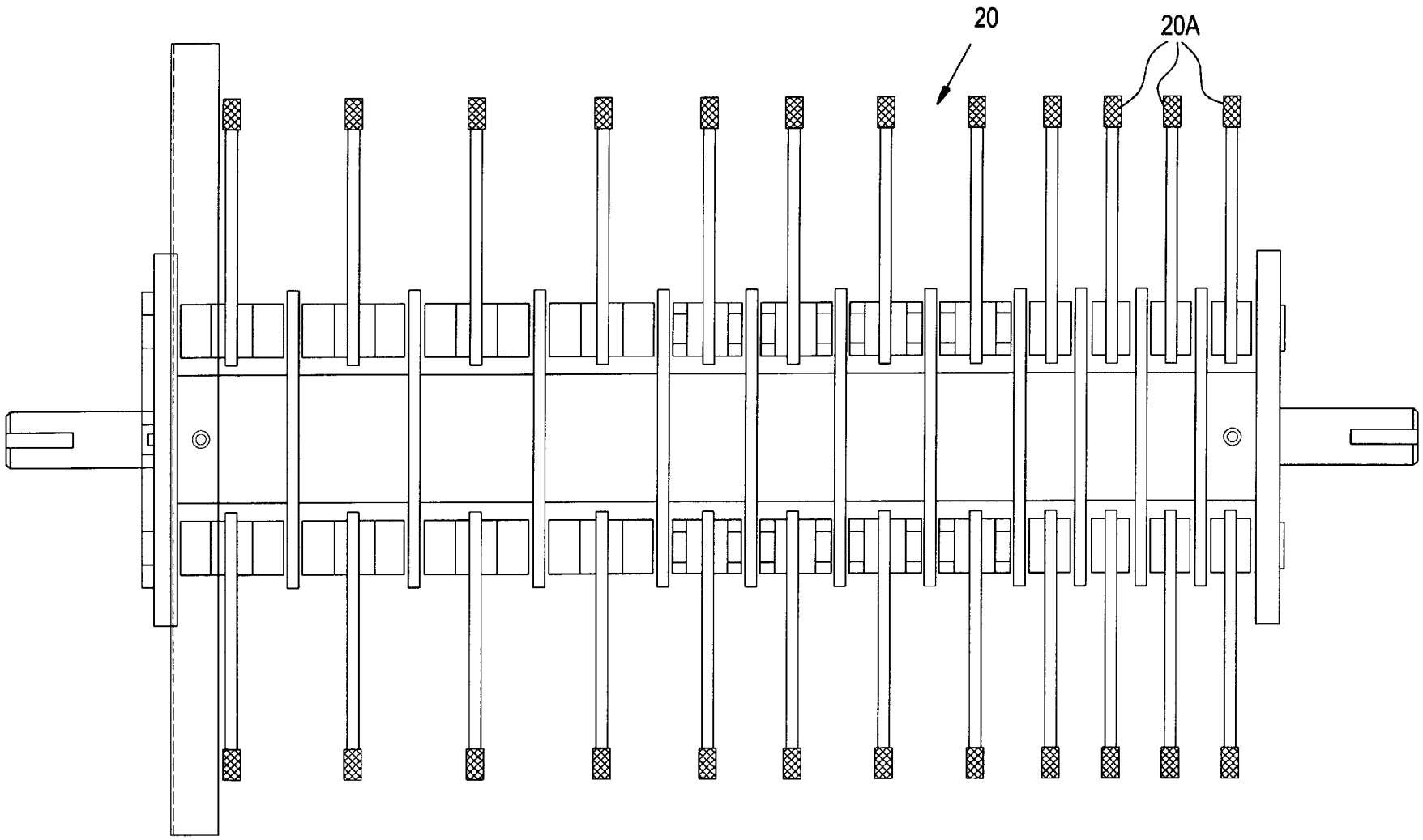
FIG. 5 is a top view of another embodiment of rotor apparatus useful in this invention.
Figure 6:
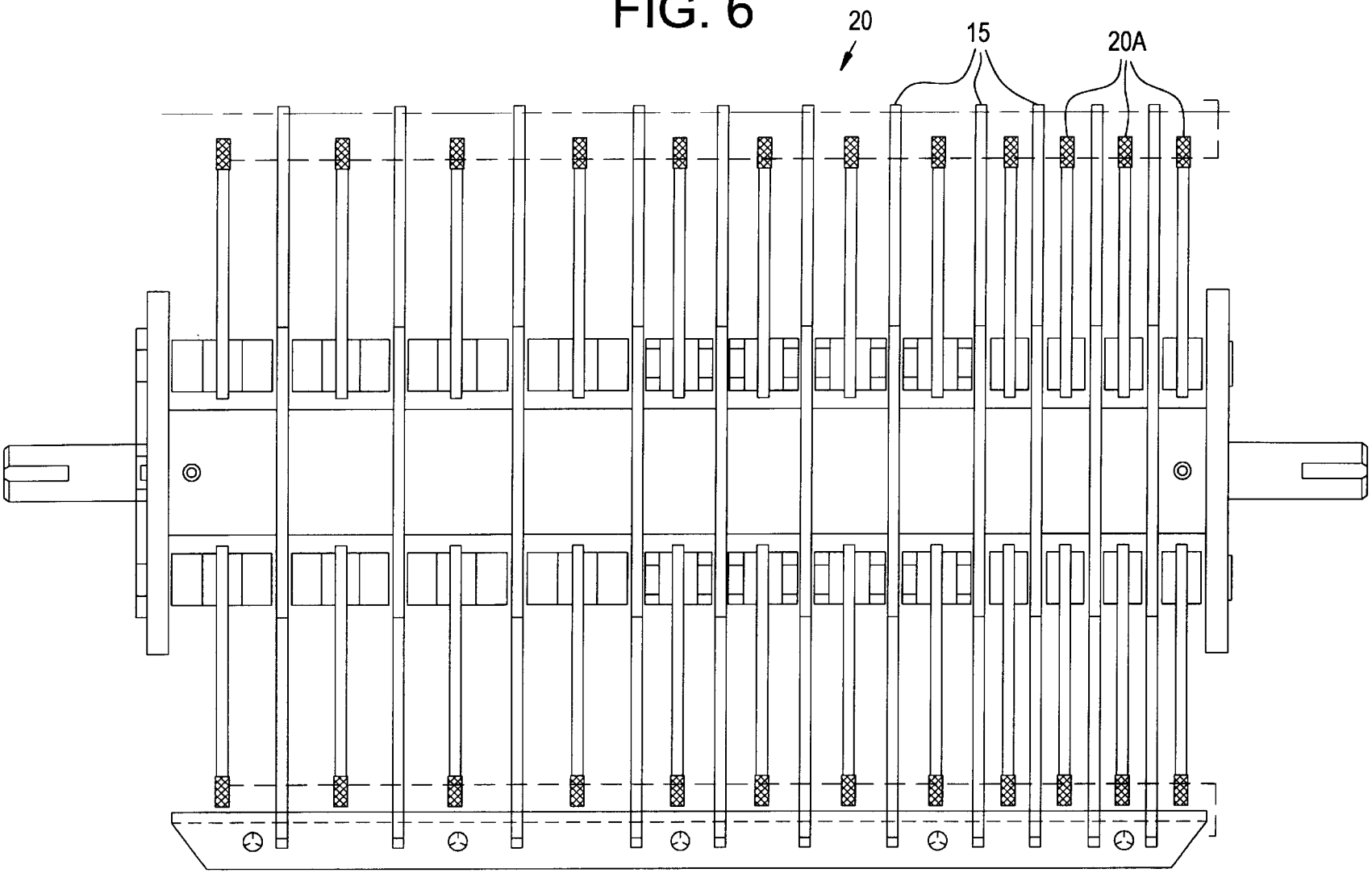
FIG. 6 is a top view of the rotor apparatus of FIG. 5 and associated feed control bars.

Because the rotor member is normally rotated at a lower rate of speed than a conventional tub grinder, it is not necessary for the rotor member to be precision machined. The rotor plates may have square holes which fit over a square shaft and are held apart by pipe spacers 23 (as shown for example in FIG. 4). Depending upon the width and number of spacers used, the hammers can be positioned closer or further apart to achieve the desired arrangement. The entire unit is assembled and then welded together. Because vibration is not nearly as much of a problem with a low speed mill, this feature reduces manufacturing costs and also extends the life of the machine.

Figure 9:
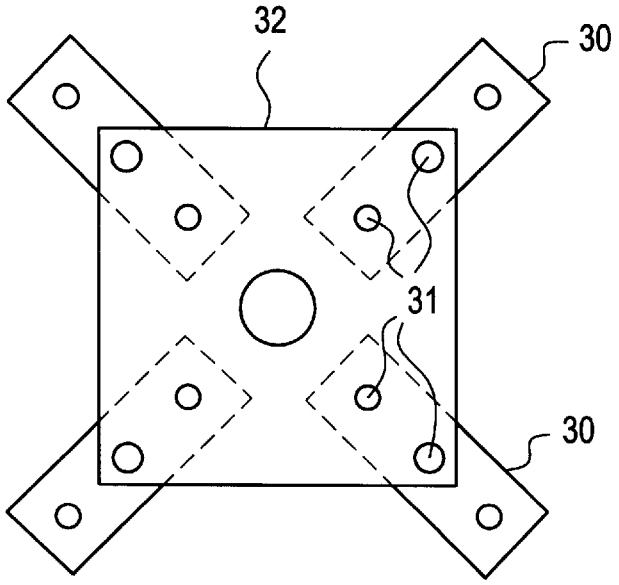
FIGS. 9 and 10 are end elevational views of other embodiments of rotors useful in this invention.
Figure 10:
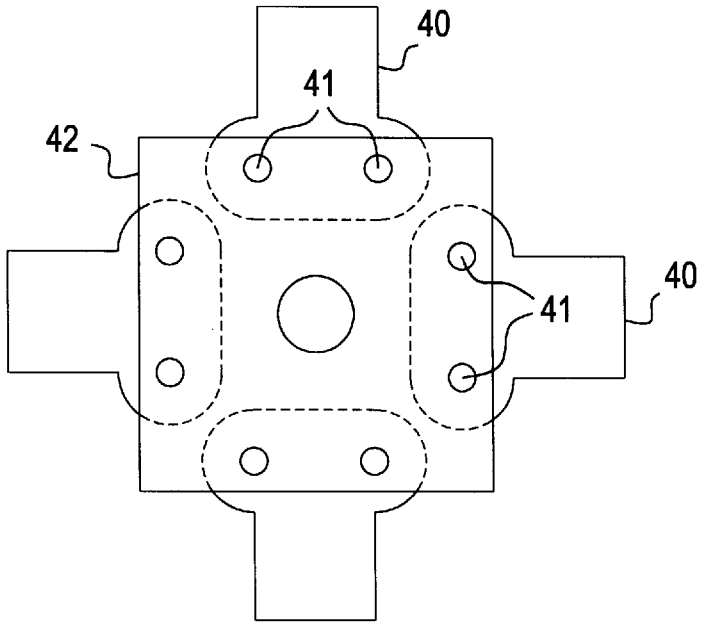

Another option for the hammer configuration used in this invention in a low speed mill is a fixed hammer (i.e. a hammer which is not pivotally mounted at one end to the rotor member). With such an arrangement, the mill can be operated at even lower tip speeds than 480 feet per second. Two such fixed-hammer arrangements are shown in FIGS. 9 and 10. In FIG. 9 each hammer 30 is secured to the rotor 32 by means of bolts 31. In FIG. 10 each hammer 40 is secured to the rotor 42 by means of bolts 41.

Another unique feature of the tub grinder apparatus is the use of all hydraulic motors to drive all secondary functions. The oil storage reserve is mounted on the front of the machine, and hydraulic oil flows through tubes which are welded to the frame 11 of the machine. These tubes circulate the hydraulic oil from the reserve tank to the drive pump and then return as the oil becomes heated. The heat is transferred into the flow tubes and then from the tubes into the frame of the machine. This makes the entire frame of the machine an oil cooler. In addition to cooling the oil, the tubes also stiffen and strengthen the side frame of the machine.

Other variants are possible without departing from the scope of this invention. For example, the principles of the invention are illustrated in the accompanying drawings, but modifications of the apparatus will be apparent to those skilled in the art.

What is claimed is:

1. Tub grinding apparatus for grinding bulk materials, the apparatus being of the type including a rotatable tub having a stationary floor with an opening therein, and an elongated rotor member with radially extending hammer elements thereon, wherein said rotor member has an inner end position near the center of said tub and an outer end positioned near the periphery of said tub and is rotatably mounted in a manner such that the hammer elements extend at least partially through said opening in said floor and into said tub, wherein the improvement comprises spacing said hammer elements along the length of said rotor member in a manner such that the spacing between adjacent hammer elements is decreased as the distance from the center of the tub is increased.

2. The improvement in accordance with claim 1, wherein said hammers are fixedly secured to said rotor member.

3. The improvement in accordance with claim 1, wherein the tip speed of said hammers is about 480 feet per second.

4. The improvement in accordance with claim 1, wherein each said hammer element comprises inner and outer ends, wherein said inner end is pivotally attached to said rotor member, and wherein said outer end is wider than said inner end.

5. The improvement in accordance with claim 1, further comprising feed control means for controlling the extent to which said hammer elements are able to penetrate said bulk material.

6. The improvement in accordance with claim 5, wherein said feed control means comprises a plurality of spaced-apart bar members extending over said opening; wherein said hammer elements extend into said tub between said bar members.

7. The improvement in accordance with claim 6, wherein each said hammer element extends between two adjacent bar members.

8. The improvement in accordance with claim 6, further comprising height control means for selectively raising or lowering said feed control means relative to said floor.

9. The improvement in accordance with claim 1, further comprising concave restricter means adjacent to and extending substantially along the length of said rotor member.

10. The improvement in accordance with claim 1, further comprising elongated auger means positioned adjacent to and extending substantially along the length of said rotor member below said floor; wherein said auger means has a length at least as long as said rotor member and is laterally spaced from the axis of said rotor member.

11. The improvement in accordance with claim 1, wherein the spacing between adjacent hammer elements is progressively decreased as the distance from the center of the tub is increased.

* * * * *